United States Patent [19]

Wright et al.

[11] 4,112,540

[45] Sep. 12, 1978

[54] ELEVATING AND SHIFTING RAILWAY CAR SLIDING DOOR MECHANISM

[75] Inventors: Glenn Lamont Wright, Canfield; James Arthur Ellis, Columbiana, both of Ohio

[73] Assignee: The Youngstown Steel Door Company, Cleveland, Ohio

[21] Appl. No.: 763,289

[22] Filed: Jan. 28, 1977

[51] Int. Cl.[2] ..... A47H 33/02; B61D 17/08; B61D 19/00; E05D 13/02

[52] U.S. Cl. ..... 16/99; 49/425; 105/378; 308/120 R

[58] Field of Search ..... 16/88, 99; 49/425, 426, 49/427; 52/64; 105/378; 308/120 R

[56] References Cited

U.S. PATENT DOCUMENTS

| | | | |
|---|---|---|---|
| 1,429,234 | 9/1922 | Gaskins | 308/120 R X |
| 1,879,369 | 9/1932 | Lute et al. | 16/99 |
| 1,943,823 | 1/1934 | Heinen | 16/99 |
| 2,387,161 | 10/1945 | Madland | 16/99 |
| 2,397,721 | 4/1946 | Blessin | 49/425 X |
| 2,496,713 | 2/1950 | Gray | 308/120 R X |
| 2,682,075 | 6/1954 | Dietrichson | 16/99 |
| 2,989,771 | 6/1961 | Szczepanik | 16/88 |
| 2,992,461 | 7/1961 | Madland | 16/99 X |
| 3,988,801 | 11/1976 | Hutchinson | 16/99 |

*Primary Examiner*—Drayton E. Hoffman
*Assistant Examiner*—Howard Beltran
*Attorney, Agent, or Firm*—John H. Mulholland

[57] ABSTRACT

A mechanism for moving a sliding door of a railway car is capable of moving the sliding door between a first position in which the sliding door is supported on the body of the railway car and closes an opening in the railway car body and a second position in which the sliding door is supported by the mechanism and is moveable along the railway car body so that cargo may be loaded and unloaded into and out of the opening in the railway car. The mechanism includes a crank and a roller rotatably mounted on the crank. The crank is rotatably mounted to the sliding door about an axis of rotation which allows movement of the roller through an opening in the bottom portion of the sliding door while limiting lateral movement of the crank which allows for clearance between the roller and the opening when the roller moves through the opening in the sliding door. An actuating member is provided and is rotatably mounted on the sliding door about an axis. The actuating member has at least one lug thereon. A connecting member is provided which is rotatably mounted to the crank and is also rotatably connected to the lug about an axis spaced from the axis of rotation of the actuating member.

1 Claim, 6 Drawing Figures

FIG. 2
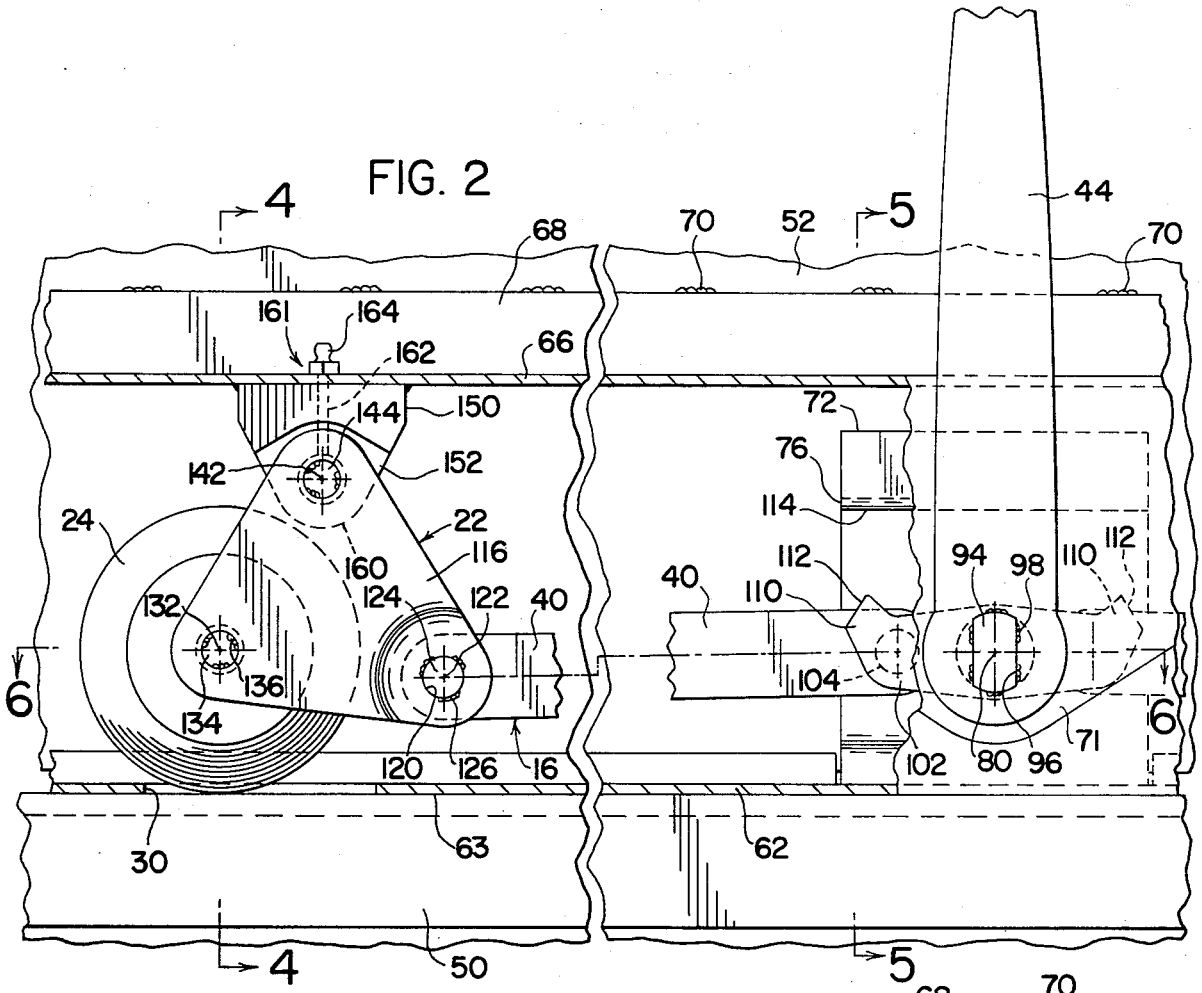
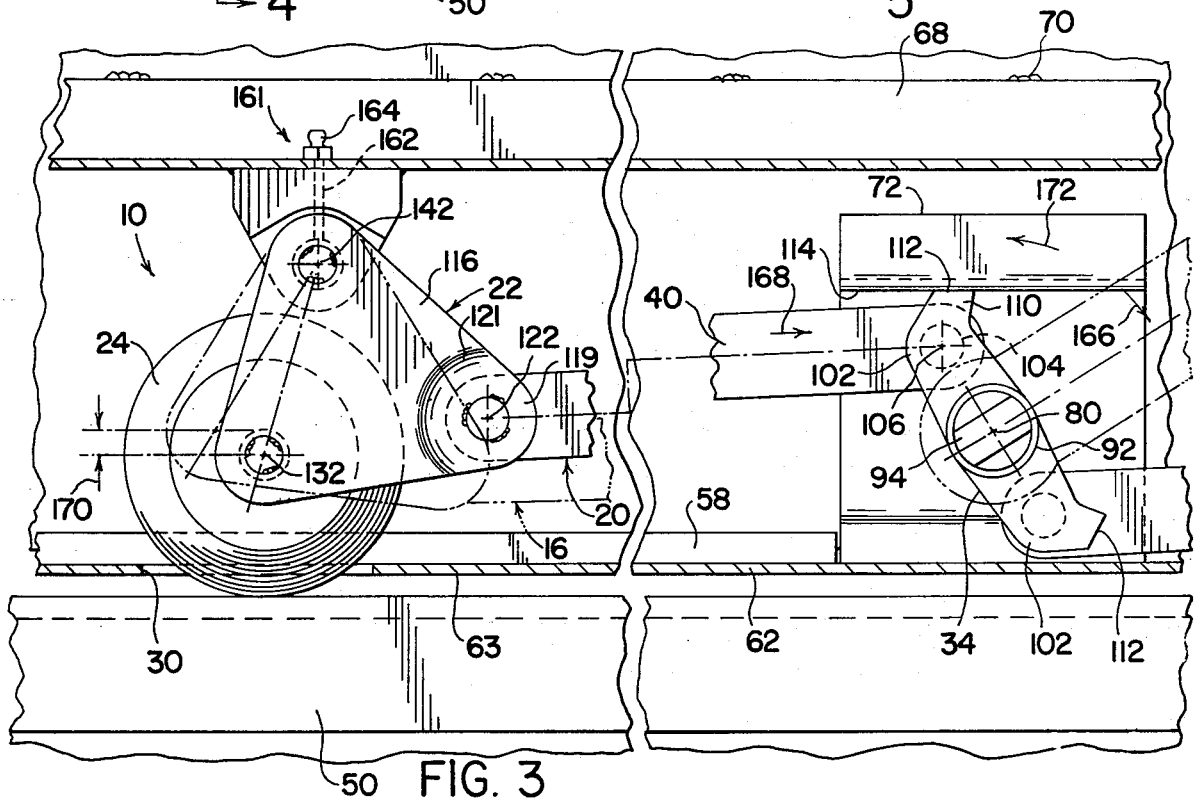
FIG. 3

ELEVATING AND SHIFTING RAILWAY CAR SLIDING DOOR MECHANISM

BACKGROUND OF THE PRESENT INVENTION

The present invention relates to a mechanism for use with a sliding door of a railway car and more particularly relates to a mechanism for moving a sliding door of a railway car between a first position in which the bottom surface of the sliding door is supported on the body of the railway car and a second position in which the sliding door is supported by the mechanism and is moveable along the railway car body.

When a railway car is in use, cargo is loaded into the railway car, transported to another location and removed from the railway car. As is well known, a railway car body has at least one opening through which cargo may be loaded and unloaded. When in transit, it is necessary to close this opening in the railway car body. Accordingly, a sliding door is provided to close the opening when the railway car is in transit. When the railway car is in transit, the sliding door is sealed against the railway car body and the cargo retained therein. When the cargo reaches its destination, it is necessary to remove the sliding door from the opening in the railway car body so that the cargo could be removed therefrom.

The prior art has shown various mechanisms which allow for movement of the sliding door between a first position in which the sliding door is supported on the railway car body and closed the opening in the railway car body and a second position in which the sliding door is supported by the mechanism and is moveable along the railway car body to allow the cargo to be removed through the opening in the railway car body.

One such prior art mechanism is disclosed in U.S. Pat. No. 2,992,461 to Madland. Madland discloses a lifting and supporting mechanism for sliding doors of railway box cars having an operating lever rotatably mounted on the sliding door and operatively connected by means of interconnecting linkage to a roller housing. The roller housing has a main and an auxiliary roller rotatably supported thereon. The main roller is capable of moving between an extended and a retracted position. The main roller is moveable from the retracted position through an opening in the bottom of the door and into contact with a door track on the railway car body. In the retracted position, the main roller is inside the sliding door.

In Madland, to move the main roller to an extended position whereby it comes in contact with the track and subsequently raises the door from the track, the operating lever is actuated and through the interconnecting linkage moves a roller hanger to which the main roller is rotatably connected. The auxiliary roller is in contact with a bearing member having a surface which converges towards the track on the railway car body. The force exerted by the operating lever on the roller hanger moves the roller hanger along the bearing surface of the bearing member in a direction so that the main roller comes into contact with the track and subsequently lifts the sliding door off of the track. In this position, the sliding door is moveable along the track on the main rollers.

When Madland's operating handle is returned to its original position, springs are provided in the linkage to assure the return of the roller housing to a position in which the main rollers are retained inside of the sliding door so that the sliding door rests on the railway car body. It should be understood that the main rollers move through openings in the bottom of the sliding door and an upturned flange is provided. One side of the roller hanger is always in a lateral overlapping relationship with the upturned flange extending inwardly from the bottom of the sliding door, so as to prevent the rollers from wearing and gouging between the roller and door.

One of the inherent problems in the lifting and supporting mechanism disclosed by Madland is that the size of the main roller is restricted. This problem is inherent in the Madland design since there must be sufficient room so that the main and auxiliary rollers do not interfere while keeping the entire mechanism in a compact space. It is obvious that if a roller of substantial diameter is used, the roller friction is decreased and accordingly, a lesser force is required to move the railway car door along the track. Another problem with the mechanism disclosed by Madland is the substantial amount of force which must be applied to the roller hanger in order to lift the door off of the railway car body. It can be seen that the roller hanger must move downwardly a sufficient distance to move the roller from inside of the sliding door to the outside of the door and lift the door off of the track a sufficient distance to allow it to roll along the track. When a substantially horizontal force is exerted on the roller hanger, the bearing member exerts not only a vertical lifting component force but also a horizontal component opposite in direction to the horizontal force exerted on the roller bracket.

It should be noted that within the design constraints on the Madland design, the vertical distance through which the roller housing must be moved in order to move the roller a sufficient distance is limited. Thus, the angle of the bearing surface of the bearing member is substantial which in turn generates substantial opposing horizontal forces. The opposing forces are further increased when dirt, silt and other foreign matter are lodged on the bearing surface of the bearing member which increases the frictional resistance to movement of the roller hanger. Thus, a greater force must be exerted on the roller hanger to raise the door. In addition, the rolling friction on the auxiliary roller creates yet another frictional force which tends to oppose raising the sliding door from the track. Yet another problem associated with the mechanism disclosed by Madland is that it is extremely difficult to provide lubrication between the bearing surface and the auxiliary roller since the entire mechanism is enclosed in a housing.

Yet another problem associated with the mechanism disclosed by Madland is that once it is desirable to lower the sliding door onto the track, springs are necessary to assure the return of the roller housing back to a retracted position so that the main roller is again positioned inside of the railway car door. This spring is also necessary to assure that the main roller and roller housing does not move while the railway car is in transit and vibrate against the track and thus damage the mechanism. This complex linkage requiring the use of the spring requires substantial metal working and additional parts in order to properly secure the spring between the linkage and the sliding door.

Another known mechanism for lifting and supporting the sliding doors of railway cars is disclosed in Dietrichson, U.S. Pat. No. 2,682,075. Dietrichson discloses a mechanism for lifting and supporting sliding doors of railway cars which includes a lift lever pivotally supported on one end thereof to the sliding door. A roller is mounted on the lever adjacent to the pivotal connection. The roller is capable of moving through an opening in the bottom of the door. The roller may be moved through the opening a sufficient distance so that the door is lifted from the frame of the railway car and may be rolled therealong.

To move the lift lever, a handle is rotatably supported on the door and has arms extending therefrom. The arms are positioned adjacent to the bearing plates When the handle is rotated, the arms move into contact with the bearing plat to urge the lift lever in a direction so that the roller is moved through the opening in the bottom of the door and into contact with the railway car body. One of the problems with this mechanism is that due to the extreme length of the lift lever disclosed by Dietrichson, it is necessary for the arms of the handle to be of substantial length to move the lift lever a sufficient distance. Due to this substantial length of the arms, the mechanical advantage is decreased and a greater force must necessarily be exerted on the lift lever. Consequently, a greater force must be exerted on the handle.

Yet another problem inherent in the mechanism disclosed by Dietrichson is that the mechanical advantage is developed over the length of a long lift lever and not at a location close to the roller. This design characteristic of the mechanism disclosed by Dietrichson requires substantial forces to be transmitted by the lift lever.

As can be clearly seen from the above, the extreme length of the lift lever requires that substantial forces be transmitted through the lift lever in order to move the rollers and correspondingly lift the door. Accordingly, Dietrichson provides a plurality of guide plates to restrict the twisting, bending and buckling of the lift lever. It should be understood that the twisting and bending and misalignment of the lift lever creates a binding between the lift lever and the guide members. Accordingly, the lift lever may bind against the guide members which produces additional forces to be overcome by the operating handle.

Another problem with the mechanism disclosed by Dietrichson is that the interface between the bearing plate and the arm of the operating handle is in sliding frictional contact with each other when the mechanism is in operation. This sliding friction requires additional forces to be exerted on the operating handle. In addition, this interface betwen the bearing plate and the arm should be constantly lubricated to minimize the abovementioned frictional losses. Dietrichson does not provide any means for readily lubricating this interface since the entire mechanism is entirely enclosed in the side of the sliding door.

Yet another problem involved with the mechanism disclosed by Dietrichson is that when the operating handle is returned to its original or normal position, the rollers should be retracted within the door. Dietrichson does not provide any positive return means for returning the rollers through the slots in the bottom of the door so that they are positioned inside of the sliding door. Rather, Dietrichson relies on the weight of the door to return the rollers to a position inside the door. This disadvantageous feature is particularly important when there is ice or dirt underneath the door which prevents the rollers from returning to their normal position. In addition, when the railway car is in transit, the rollers are free to vibrate against other door components since the rollers are not positively returned or otherwise restrained when the sliding door is in the normally closed position.

SUMMARY OF THE INVENTION

The present invention provides a mechanism for moving a sliding door of a railway car between a first position in which the bottom surface of the sliding door is supported on the body of a railway car and a second position in which the sliding door is supported by the mechanism and is moveable along the railway car body. The mechanism of the present invention comprises: a crank with a roller rotatably mounted on the crank. Means are provided for rotatably mounting the crank on the sliding door about an axis of rotation which allows movement of the roller through an opening in the bottom portion of the sliding door while limiting lateral movement of the crank which allows for clearance between the roller and the opening when the roller moves through the opening. An actuating member is also provided and is rotatably mounted on the sliding door. The actuating member has at least one lug thereon. The mechanism includes a connecting member having one end rotatably connected to the lug of the actuating member and the other end rotatably connected to the crank.

The present invention provides a mechanism having an improved mechanical advantage for designs in which the mechanical advantage is generated close to the roller. By pivotally connecting the crank to the sliding door and pivotally connecting the crank to the actuating means through the connecting member, the force generated by the actuating member creates a substantial rotational moment about the rotational axis of the crank. This substantial rotational moment of the crank creates a substantial force on the roller as it is urged downwardly towards the railway car body.

In addition, the mechanism of the present invention does not transmit bending forces through the connecting links or lift lever since all of the connections are pivotal connections. The connecting link transmits compressive and tensile forces and the mechanical advantage of the mechanism concentrates higher forces close to the roller which minimizes the forces to be transmitted through the connecting link. Since the basic loading on the connecting member is either compressive or tensile, it may be more properly designed without requiring the use of guide members to prevent bending and twisting thereof and still be maintained in a small space so that the entire mechanism remains compact.

The present invention also provides lubrication means for lubricating the mechanism without disassembling the sliding door to thereby minimize frictional forces.

In addition, the mechanism of the present invention also minimizes frictional losses since all of the connections of the linkage are pivoting connections and there are no sliding or rolling connections as required by the prior art designs. A pivotal connection has substantially lesser friction than sliding or rolling connections when used to perform the same functions in a mechanism.

The present invention also allows larger rollers upon which the sliding door is moved to be used. This design feature is accomplished by minimizing the size of the pivotal connection between the crank and the sliding door. When the size of this pivotal connection is minimized, a larger roller may be used and have a diameter so that the outer peripheral surface of the roller is in close proximity to the pivotal connection between the door and the crank. By providing a roller of larger diameter, the door may be more easily moved along the track of the railway car. The present invention achieves this favorable objective while still maintaining the mechanism in the compact space.

The present invention provides a positive return for the rollers so that when it is desirable to move the rollers upwardly so that the door is supported on the railway car body, the rollers are positively returned to their position inside of the door. This is important since in certain cases, ice, dirt or other obstructions may prohibit the rollers from positively returning to their original position. In addition, ice, dirt or other obstructions may build up underneath areas adjacent to the rollers and prohibit sealing of the door. As discussed above, the prior art has disclosed both the spring returns and gravity returns for the rollers. The gravity return design utilizes the weight of the door to urge the rollers back to the inside of the door when the door is lowered. This design is inherently defective since when the railway car is in operation, the rollers vibrate against other parts of the door. Other designs utilize springs to return the roller to its original position and accordingly, require more complex linkage to accomplish this result.

The present invention provides for positive returning the rollers without complex linkage and does not rely on gravity to return the roller to its retracted position in the railway car.

It is an object of the present invention to provide a new and improved lifting and supporting mechanism for sliding doors of railway cars which embodies an improved mechanical linkage which generates a mechanical advantage close to the roller.

It is a further object of this invention to provide a new and improved lifting and supporting mechanism for sliding doors of railway cars which minimizes the frictional losses during operation of the linkage so that the efficiency of the linkage is maximized.

It is yet another object of the present invention to provide a new and improved lifting and supporting mechanism for sliding doors of railway cars which allows the use of large rollers upon which to support and move the door with respect to the railway car body.

It is yet another object of the present invention to provide a new and improved lifting and supporting mechanism for sliding doors of railway cars which does not necessitate the use of guide members for guiding the linkage and assuring alignment of the linkage.

It is yet a further object of the present invention to provide a new and improved lifting and supporting mechanism for sliding doors of railway cars which provides lubrication means for lubricating important points on the linkage.

It is a further object of the present invention to provide a new and improved lifting and supporting mechanism for sliding doors of railway cars which provides a simplified linkage.

It is a still further object of the present invention to provide a new and improved lifting and supporting mechanism for sliding doors of railway cars which provides for positive movement and return of the mechanism in both directions without the use of any associated springs or the weight of the door.

Other objects and advantages of the present invention will appear during the course of the following description with reference to the annexed drawings in which like parts are designated by like numerals throughout.

DESCRIPTION OF THE DRAWINGS

In the drawings forming a part of this specification:

FIG. 2 is an expanded view of the FIG. 1 with additional parts being broken away to more clearly show the lifting and supporting mechanism embodying the present invention as shown in FIG. 1;

FIG. 3 is an elevational view of the lifting and supporting mechanism shown in FIG. 2 in another operative position;

DETAILED DESCRIPTION OF THE INVENTION

Figure 1:
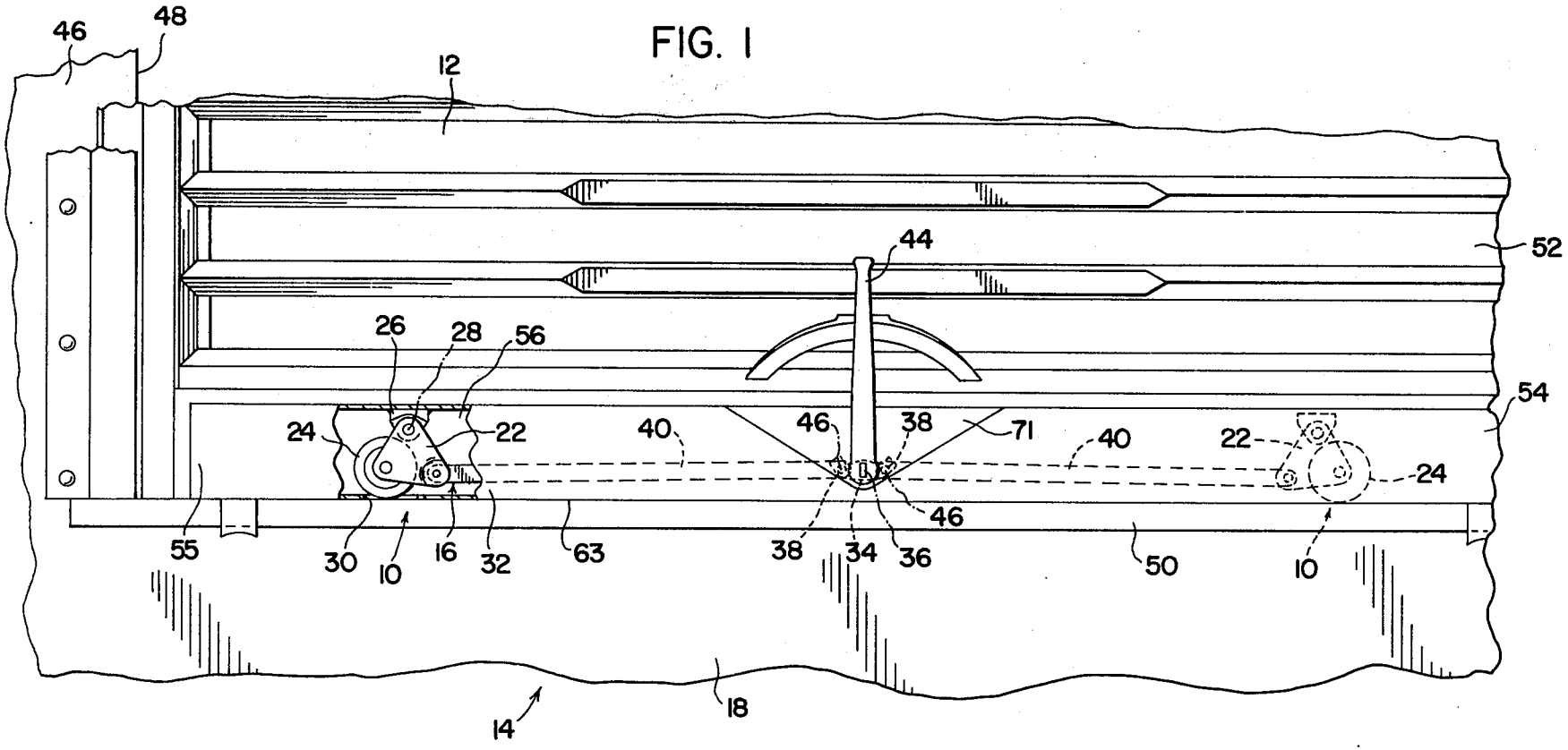
FIG. 1 is an elevational view of a portion of a railway car and the lower portion of a sliding door mounted thereon and equipped with a lifting and supporting mechanism embodying the present invention, certain parts being broken away.

The present invention provides a new and improved mechanism 10 for moving a sliding door, partially indicated at 12 in FIG. 1, of a railway car 14 between a first position 16, in which the bottom surface 63 of the sliding door is supported on the body 18 of the railway car 14, and a second position 20 shown in FIG. 3 in which the sliding door is supported by the mechanism 10 and is moveable along the railway car body. The mechanism 10 includes a crank means 22 having a roller 24 rotatably mounted on the crank means. Means 26 are provided for rotatably mounting the crank 22 on the sliding door 12 about an axis of rotation 28. The rotatable mounting means 26 allows the roller 24 to be moved through an opening 30 in the bottom portion 32 of the sliding door 12 while limiting the lateral movement of the crank 22 to allow for clearance between the roller and the opening when the roller moves through the opening. The mechanism 10 also includes an actuating member 34 which is rotatably mounted on the sliding door 12 about an axis 36. The actuating member 34 has lugs 38 thereon. The mechanism 10 also includes a connecting member 40 rotatably connected on one end to the crank 22 and rotatably connected to the lug 38 about an axis 42 which is spaced from the axis of rotation 36 of the actuating member 34. An operating handle 44 is operatively connected to the actuating member 34 to exert a force from the actuating member. The mechanism 10 transfers the force exerted on the operating handle 44 to the roller 24 to move the roller and consequently move the sliding door between the first position 16 and the second position 20.

The railway car 14 includes a sidewall 46, a portion of which is shown in FIG. 1. The opening 48 is customarily provided in railway car sidewalls and is adapted to be closed by means of the sliding door 12, fragmentarily illustrated in FIG. 1. When it is desirable to load or unload cargo from the railway car 14, the sliding door 12 is moved from the opening 48 and along the railway car sidewall. When the railway car 14 is in transit, it is desirable to secure the cargo by closing the sliding door 12 and securing it in place so that the cargo is retained therein and may not be removed from the railway car.

The door is adapted to be supported both frictionally and for antifrictional movement on a door track 50 which is secured to other members of the railway car body 18 in any manner well known to those skilled in the art, such as welding.

The sliding door 12, except as hereinafter described, may be of any known construction. One known design is shown in FIG. 1 and includes a corrugated panel 52 and a bottom reinforcing member 54. The bottom reinforcing member 54 is of a generally channel-shaped configuration and is provided to structurally reinforce the bottom of the door of the sliding door 12 and house the mechanism 10. The bottom reinforcing member extends along the bottom of the door 12 and is closed at its end portions 55 to provide an enclosed housing 56.

Figure 4:
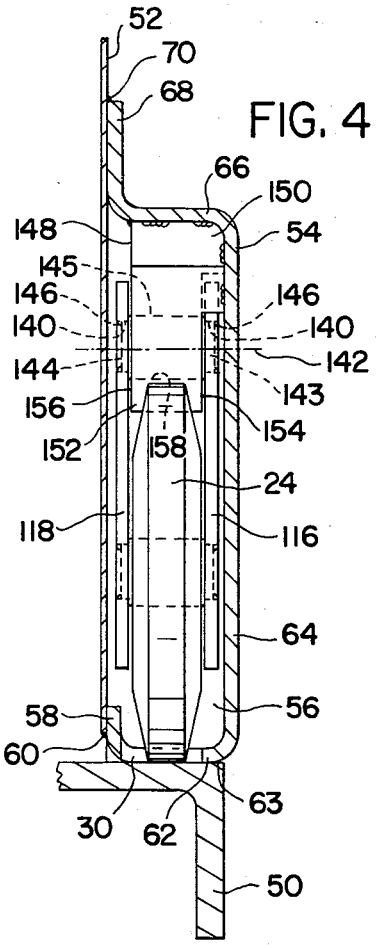
FIG. 4 is a sectional view of the mechanism and sliding door shown in FIG. 2 and taken along lines 4—4 thereof.

To define the general channel configuration of the bottom reinforcing member 54, the following description thereof will be made in connection with FIGS. 2, 4 and 5 of the drawings. Extending throughout the length of the bottom reinforcing member 54, except for the central portion as will be hereinafter described in connection with FIG. 5, the bottom reinforcing member 54 has a bottom flange portion 58 extending downwardly and terminating in a support portion 62. The bottom flange 58 is secured to the door by any conventional means, such as welds 60.

The support portion 62 extends horizontally across the bottom of the door and defines the bottom surface 63 of the door 12 which contacts the track 50. As clearly illustrated in the drawings the support portion 62 of the bottom reinforcing member 54 serves to support the door 12 frictionally upon the track 50 when the door is lowered.

The opening 30 is formed in the support portion 62 and is of a sufficient width to allow the roller 24 to pass therethrough and a sufficient length to allow for complete movement of the roller 24 from a retracted position 16 in which the roller 24 is housed in the housing 56 and an extended position 20 in which the roller 24 extends downwardly from the bottom surface 63 of the support portion 62 to moveably support the door 12 on the track 50. The bottom reinforcing member 54 also includes a vertical front portion 64 extending upwardly from the support portion 62. The vertical front portion 64 has a sufficient size to house the mechanism 10 therein, as will hereinafter be described.

The bottom reinforcing member 54 also has a portion 66 extending inwardly from the vertical front portion 64 in a direction towards the panel 52 and a securement flange portion 68 extending vertically upwardly along the door panel 52. The securement flange portion 68 is secured to the panel 52 by any conventional means such as welding indicated at 70 in FIG. 4.

It should be understood that in the mechanism 10 disclosed in the drawings, two rollers 24 are provided as seen in FIG. 24 and the actuating member 34 is centrally located therebetween. Upon movement of the actuating member 34 by movement of the handle 44 both of the rollers 24 will be moved in unison.

In order to accommodate such movement of the handle 44 and properly mount the actuating member 34 to the door 12, the bottom reinforcing member 54 has an indentation 71. The indentation 71 is generally triangular in geometric configuration, as seen in FIGS. 1 and 5. The indentation 71 provides for clearance between the handle 44 and the bottom reinforcing member 54.

Figure 5:
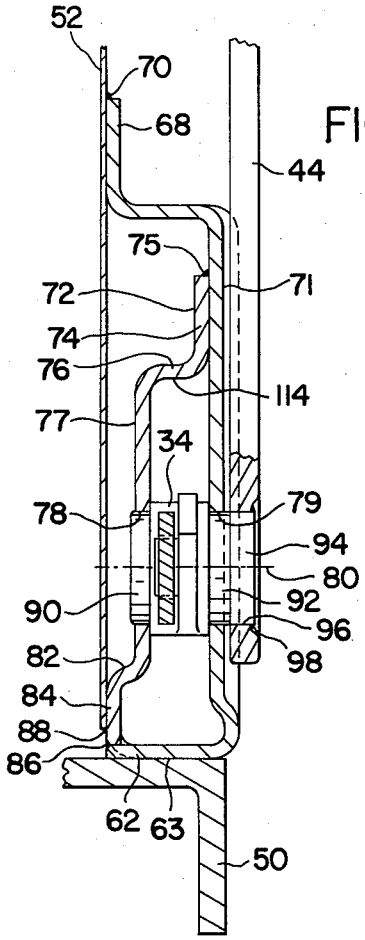
FIG. 5 is a sectional view of the mechanism and sliding door shown in FIG. 2 and taken along lines 5—5 thereof.
Figure 6:
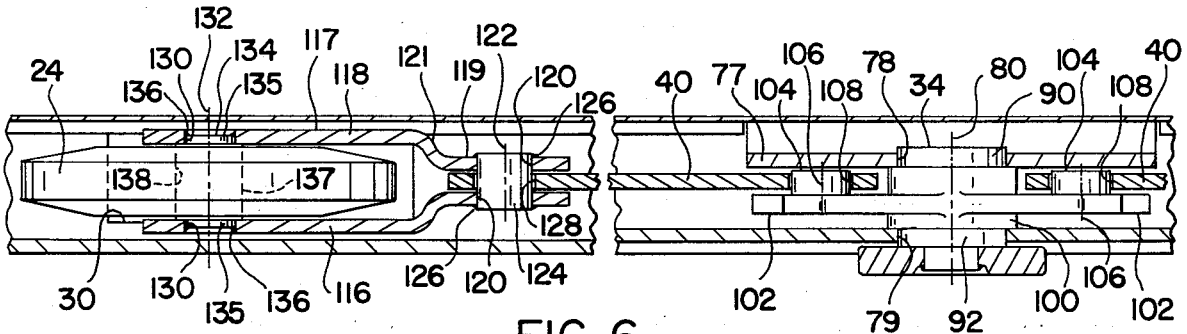
FIG. 6 is a sectional view of the mechanism and sliding door shown in FIG. 2 and taken along lines 6—6 thereof.

In the central area in which the indentation 71 is formed, a reinforcing member 72 is provided to rotatably support and mount the actuating member 34 and further reinforce the sliding door 12 in this area, as seen in FIGS. 5 and 6. The reinforcing member 72 includes an inner vertical portion 74 secured to the inner surface of the indented portion 71 of the front portion 64 of the bottom reinforcing member 54 by any conventional means, such as a weld 75.

The reinforcing member 72 also includes a spacing section 76 extending from the inner portion 74 and a support section 77 extending from the spacing section 76. The support section 77 has an opening 78 therein and the bottom reinforcing member 54 has an opening 79 therein which openings 78, 79 are adapted to rotatably house the actuating member 34 as will be hereinafter described. The openings 78 and 79 are circular in configuration and are in alignment with the axis 80 so that they provide journal surfaces for rotation of the actuating member 34 as will hereinafter be described.

The reinforcing member 72 has a spacing section 82 extending from the support section 77 and an outer vertical section 84 extending from the spacing section, as seen in FIG. 5. The outer vertical section is secured to the support portion 62 of the bottom reinforcing member 54 and the door panel 52 by means of welds 86 and 88, respectively.

As can be seen in FIG. 1, the mechanism 10, as applied to the sliding door 12, has two sets of cranks 22 and rollers 24 which are spaced from each other. The actuating member 34 is centrally located between these cranks and rollers, 22 and 24 respectively, and is connected to the cranks by two connecting members 40. For ease of description, one of the crank 22 and roller 24 assemblies will be hereinafter described. It should be understood that other crank and roller assemblies may be operated in a similar manner and that any number of crank and roller assemblies may be provided on the sliding door 12 and connected to the actuating member 34 by means of additional connecting members 40.

As seen in FIG. 5, the actuating member 34 has first and second bearing portions 90, 92 adapted to be rotatably retained and supported by the openings 78 and 79, respectively. The actuating member 34 also includes a projecting portion 94 projecting outwardly of the indentation 71 of the bottom reinforcing member 54. The operating handle 44 has an opening 96 therein which is complementary in shape with projecting portion 94 of the actuating member 34. The particularly geometric configuration of the projecting portion 94 and complimentary opening 96 in the operating handle 44 provides for transmitting torque therebetween. The handle 44 and actuating member 34 are secured together by any conventional means, such as the welds 98. Thus, when the operating handle 44 is rotated, the actuating member 34 is correspondingly rotated.

As seen in FIG. 6, the actuating member 34 has a central portion 100 between the bearing portions 90 and 92. Extending from the central portion 100 are lugs 102 having bosses 104 thereon. The bosses are generally circular in cross-sectional configuration and are provided for rotatably connecting the connecting members 40 to the actuating member 34. The connecting members 40 have an opening 108 in one end thereof. The opening 108 is of sufficient size to receive the bosses 104 and provide for free rotational movement and alignment of the connecting member 40 and other parts of the mechanism 10, as will be hereinafter more fully described.

When the door panel 52, bottom reinforcing member 54, reinforcing member 72 and actuating member 34 are assembled, the connecting members 40 are assembled with the actuating member 34 so that the openings 108 of the connecting members 40 are positioned on the bosses 104. The bosses 104 are of a sufficient length so that there is a slight gap between the end of the bosses 104 and the inner surface of the support section 77. Thus, when the bottom reinforcing member 54 and reinforcing member 72 are assembled, the connecting link is retained on the bosses 104 and is restricted in lateral movement by the lugs 102 and the support section 77 of the reinforcing member 72. The space between the bosses 104 and the inner surface of the support section 77 of the reinforcing member 72 is not sufficient to allow the connecting member 40 to be removed therefrom. Thus, as can be seen from the above, the connecting member 40 may be moved a limited lateral distance rotated about its longitudinal axis a slight amount so as to allow for alignment of the connecting link 40 as will hereinafter be more fully described.

The boss 104 of the actuating member 34 and the opening 108 of the connecting member 40 is positioned about an axis 106 which is spaced from the rotational axis 80 of the actuating member 34. The space between these axes 80, 106 provides for lateral movement of the connecting link 40 upon rotation of the actuating member 34.

As seen in FIGS. 2 and 3, the actuating member 34 includes stop portions 110 on each of the lugs 102. The stop portions 110 have stop surfaces 112 which prevent overtravel of the actuating member 34. When the limit of rotation of the actuating member 34 is reached, the stop surfaces 112 of the stop portions 110 contact the inner surface 114 of the spacing portion 76 of the reinforcing member 72. Thus, movement of the linkage of the mechanism 10 to an over center position is prohibited.

As best seen in FIGS. 2 and 6, the connecting link 40 is rotatably connected to the crank means 22. The crank means 22 includes crank plates 116 and 118 which are generally triangular in shape and are mirror images of each other. Each of the crank plates 116 and 118 has an outer portion 117 and an inner portion 119 interconnected by a connecting portion 121 as clearly seen in FIG. 6. The crank plates are made of rigid material and used to transmit force from the connecting link 40 to the roller 24.

In order to connect the connecting link 40 to the crank plates 116 and 118, the crank plates have a pin opening 120 at one apex thereof. The opening 120 is generally circular in cross-section and centered about the axis 122. A pin 124 is provided for positioning in the pin openings 120 of the crank plates 116 and 118. The connecting link 40 has an opening 128 therein which receives the pin 124 and is positioned between the crank plates 116 and 118. The opening 128 is slightly larger than the diameter of the pin 124 to allow for angular alignment of the connecting link 40. In addition to the thickness of the connecting link 40, an additional space is provided between the crank plates 116 and 118 to allow for some slight lateral movement of the connecting link 40 to provide for lateral alignment of the connecting link between the crank means 22 and the actuating member 34. The pin 124 is secured to the crank plates 116 and 118 by welds 126 to assure that the distance between the crank plates as described above is maintained and to prevent disassembly of the connecting link 40 with the crank means 22. Thus, the connecting link 40 is rotatably connected to the crank means about the axis 122, while some rotation of the connecting link 40 is allowed about its longitudinal axis.

The roller 24 is rotatably mounted to the crank plates 116 and 118 about an axis 132. The outer portions 117 of the crank plates 116 and 118 have a shaft opening 130 therein which is generally circular in cross-sectional configuration and in alignment with the axis 142. The roller 24 has an opening 138 therethrough of greater diameter than the opening 130 in the roller 24.

The pin 134, which is provided to rotatably connect the crank plates 116 and 118 with the roller 24, has a centrally located journal portion 137 and retaining portions 135 on the outward ends of the journal portion 137. The journal portion 137 is circular in cross-section and is of a width slightly greater than the width of the roller 24 so as to allow a slight amount of lateral movement between the roller 24 and the crank plates 116 and 118 and thereby avoid binding therebetween. The retaining portions 135 are generally circular in cross-section and of a slightly smaller diameter than the journal portion 137 slightly smaller in diameter than the openings 130 in the crank plates 116 and 118. Thus, when the crank plates 116 and 118 are assembled with the roller 24 and pin 134 in place, they abut the shoulder between the retaining portions 135 and journal portion 137 of the pin 134. Once this assembly is accomplished, the pin 134 is secured in position on the crank plates 116 and 118 by means of welds 136.

In order to rotatably secure the crank means 22 to the sliding door 12, a bearing 148 is provided and is secured to the sliding door 12 as will be hereinafter described. Another apex of the triangularly shaped crank plate 116 and 118 is a shaft opening 140 which opening is generally circular in section and centered about the axis 142 as seen in FIGS. 2 and 4.

The bearing member 148 has a base portion 150 and a journal portion 152. The journal portion 152 has side faces 154 and 156 on opposite sides thereof and an opening 158 passing therethrough. In order to rotatably secure the crank means 22 to the sliding door 12 and bearing 148, a shaft 144 is provided, having a centrally located journal portion 145 and retaining portions 143 on opposite ends thereof. The opening 158 in the bearing 148 is of a greater diameter than the opening 140 in the crank plates 116 and 118. The journal portion 145 of the shaft 144 is of a size which it is free to rotate in the opening 158 of the bearing 148. The distance between the side faces 154 and 156 of the journal portion 152 of the bearing 148 is a slightly lesser distance than the distance between the crank plates 116 and 118, which distance is determined above as described in connection with the distance between the crank plates 116 and 118 to accommodate the roller 24. The length of the journal portion 145 of the shaft 144 is slightly greater than the distance between the side faces 154 and 156 of the bearing 148, so as to allow some slight lateral movement of the crank means 22 but operating as means to limit the movement of the crank means 22 so that the roller may move through the opening 30 without interference with the bottom reinforcing member 54. Thus, means are provided for limiting the lateral movement of the crank means 22 while allowing for clearance between the roller 24 and the opening 30 when the roller 24 moves through the opening.

When assembled, the crank plates 116 and 118 are positioned on the shaft 144 with the openings 140 thereof on the retaining portions 143 of the shaft 144 and secured thereon by means of welds 146.

As shown in FIG. 2, the journal portion 152 of the bearing has an outer surface 160 which is generally arcuate in shape. It is desirable to form the outer surface as close to the rotational axis 142 so as to allow a maximum size of roller 24 to be used. By minimizing the distance between the outer surface 160 and 142 and forming it in an arcuate shape, the diameter of the roller 24 may be maximized. By using the maximum diameter of the roller, the frictional forces required to roll the door 12 on the track 50 are minimized.

In the construction of a sliding door 12 with a lifting mechanism, it is important to provide for proper lubrication of certain connections. As described above, the mechanism 10 is located in an enclosed housing 56. Accordingly, the door 12 may not be disassembled to lubricate the mechanism and lubrication means 161 must be provided to supply lubrication to desired journals. Such lubrication minimizes the friction and optimizes the operating characteristics of the mechanism 10. The lubrication means 161 includes a lubrication opening 162 which extends from the opening 158 in the journal portion 152 of the bearing 148, through the base portion 150 of of the bearing 148 and through the inwardly extending portion 166 of the bottom reinforcing member 54. The lubrication means 161 also includes a fitting 164 as seen in FIG. 2. The fitting 164 is of any conventional design and allows for supplying lubrication through the opening 162 to the opening 158 of the bearing 148.

In operation, mechanism 10 is in a first position 16 in which the sliding door 12 is resting on the track 50 and a second position 20 in which the sliding door 12 is supported by the rollers 24 on the track 50. In the second position 20, the railway car door is free to roll along the side of the railway car 14 on the track 50. The first position 16 of the mechanism 10 is best shown in FIG. 2 and in phantom lines in FIG. 3 while the second position of the mechanism 10 is best shown at 20 in FIG. 3.

In order to move the mechanism 10 from the first position 16 to the second position 20, a force is applied by an operator to the outer end of the operating handle 44 in the direction indicated by the arrow 166 in FIG. 3. As the operating handle 44 is so rotated, the actuating member 34 is rotated in a like direction and consequently, the connecting member 40 is moved in a direction indicated by the arrow 168. The force exerted on the connecting member 40 is greater than the force exerted on the handle 44 due to the fact that the axes 106 and 80 are closer than the distance between the point where the manual force is exerted on the handle 44 and the axis 80. Thus, the amount of force exerted on the handle 44 is multiplied and exerts a greater force on the connecting member 40.

The operating mechanism of the present invention provides for force multiplication and increasing the amount of force utilizing leverage principles close to the roller, as will be hereinafter described. The force exerted on the connecting link is purely tensile or compressive in nature and accordingly, no guide members are necessary to avoid twisting or lateral bending of the connecting member 40. Accordingly, there are no frictional losses due to abrasion with guide members.

When the force is exerted on the connecting member 40, force is exerted on the crank means 22 about the axis 122. This force creates a moment about the axis 142. The greater the distance of the moment arm, which is a line passing through the axis 142 and vertical to a line between the axes 106 and 122, the greater the moment that will be produced. The greater the moment that is produced, the greater the force which will be exerted on the roller 24. It should be understood though that as the moment arm is increased the amount of angular movement of the crank will decrease.

In the particular mechanism shown in the drawings, when the mechanism 10 is in the first position 16, the moment arm is a greater distance than the distance between the axes 132, 142. When the mechanism 10 is in the second position 20, the moment arm is a lesser distance than the distance between the axes 132, 142. Thus, as the mechanism 10 begins to move from the first position 16 to the second position 20, the roller is moved through a lesser distance but with a greater force due to the leverage created by the difference between the distance between the moment arm and the distance between the axes 132, 142. On the other hand, as the moment arm decreases to a distance lesser than the distance between the axes 132, 142, the roller moves through a greater distance with a lesser force. This design is particularly advantageous since a greater force is necessary to begin movement of the door and overcome the inertial and binding forces on the door and after those forces are overcome, the door may be raised the necessary distance without the necessity of a greater force. It is apparent from the above that by changing the position of the axis 122 of the connecting link 40 and the crank means 22, the force exerted on the roller 24 and the distance through which the roller is moved may be adjusted to meet various design perameters.

The present design maximizes this moment arm while providing for sufficient movement of the roller 24. Thus, the mechanism 10 of the present invention provides a mechanical linkage which provides a mechanical advantage close to the roller 24 while having the ability to move the roller 24 a sufficient distance, which distance is generally indicated at 170.

When the roller is in contact with the track 50, it supports a sliding door 12 thereon and the door is free to be manually or otherwise moved therealong. As described above, the stop portions 110 on the autuating member 34 prohibit overtravel of the actuating member. Thus, the linkage is prohibited from moving over center.

When it is desirable to return the roller 24 to its retracted or first position 16, the handle 44 is rotated in an opposite direction 172 until the handle reaches an upright position. Thus, the connecting member 40 transmits this rotational force to the roller 24 in a manner similar to that described above in connection with the lowering of the roller. Thus, the roller 24 is moved to its retracted position in a positive manner and when the roller is so returned, the door 12 is supported by the track 50. It is important to understand the advantageous nature of this positive return feature since if there is ice or dirt blocking the return of the door, the rollers will nevertheless be retracted into the housing 56 and positively retained therein so as to avoid wear of the rollers on other parts of the sliding door 12. This mechanism provides a positive return without the necessity of other linkages or members such as springs.

From the above description, it can be seen that all the connections between the parts of the mechanism 10 are rotational or pivotal connections. This feature is advantageous in that any rolling or sliding contacts require additional frictional forces which in turn create a less efficient linkage due to the frictional losses. The linkage of the present invention minimizes these frictional losses.

Having described my invention, I claim:

1. A mechanism for moving a sliding door of a railway car between a first position in which the bottom surface of the sliding door is supported on the body of the railway car and a second position in which the sliding door is supported by said mechanism and is moveable along the railway car body, said mechanism comprising:

a pair of crank means;

a roller mounted on each of said crank means for rotation about first axes;

means for mounting said crank means to the sliding door for rotation about second axes spaced between said first axes which allow limited arcuate movement of said rollers through a pair of openings in the bottom portion of the sliding door in arcs which provide clearance between said rollers and the openings when said rollers move partially into and out of the openings;

a selectively manually operated actuating member mounted on the sliding door for rotation about a third axis, said actuating member having a pair of lugs thereon;

a pair of single elongated connecting links connected to said crank means for rotation about fourth axes spaced between said second axes and connected to said lugs for rotation about fifth axes spaced from the third axis of rotation of said actuating member;

said third, fourth and fifth named axes being located in the area between the bottom of said rollers and said second axes when said sliding door is in both said first position and said second position, thereby providing a compact and efficient mechanism having the capability of positively selectively driving said door between said first and second positions.

* * * * *